US006185277B1

(12) United States Patent
Harding

(10) Patent No.: US 6,185,277 B1
(45) Date of Patent: Feb. 6, 2001

(54) X-RAY SOURCE HAVING A LIQUID METAL TARGET

(75) Inventor: Geoffrey Harding, Hamburg (DE)

(73) Assignee: U.S. Philips Corporation, New York, NY (US)

( * ) Notice: Under 35 U.S.C. 154(b), the term of this patent shall be extended for 0 days.

(21) Appl. No.: 09/307,156

(22) Filed: May 7, 1999

(30) Foreign Application Priority Data

May 15, 1998 (DE) ..... 198 21 939

(51) Int. Cl.[7] ..... H01J 35/08
(52) U.S. Cl. ..... 378/143; 378/125
(58) Field of Search ..... 378/143, 125, 378/121, 119

(56) References Cited

U.S. PATENT DOCUMENTS 4,723,262 * 2/1988 Noda et al. ..... 378/143
4,953,191 8/1990 Smither et al. ..... 378/143
5,052,034 * 9/1991 Schuster ..... 378/143

FOREIGN PATENT DOCUMENTS 08036978A 2/1996 (JP) ..... H01J/35/00

* cited by examiner

*Primary Examiner*—David P. Porta
*Assistant Examiner*—Drew A. Dunn
(74) *Attorney, Agent, or Firm*—John F. Vodopia

(57) ABSTRACT

The invention relates to an X-ray tube having a liquid metal target. The electrons emitted by the electron source (3) enter the liquid metal through a thin window (2) and produce X-rays therein. The liquid metal, having a high atomic number, circulates under the influence of a pump so that the heat produced by the interaction with the electrons in the window and the liquid metal can be dissipated. The heat generated at this area is dissipated by a turbulent flow, thus ensuring effective cooling.

10 Claims, 1 Drawing Sheet

X-RAY SOURCE HAVING A LIQUID METAL TARGET

BACKGROUND OF THE INVENTION

1. Field of the Invention

The invention relates to an X-ray source which includes an electron source for the emission of electrons and a target which emits X-rays in response to the incidence of the electrons and consists of a liquid metal which circulates in the operating condition of the X-ray source.

2. Description of Related Art

An X-ray source of this kind is known from U.S. Pat. No. 4,953,191. The liquid metal therein is contained in a pumping circuit which includes a distribution head wherefrom the liquid metal flows across a stainless steel plate and into a collecting basin wherefrom it is subsequently pumped to the distribution head again. The electron beam is incident on the liquid metal flowing across the stainless steel plate and generates X-rays therein.

The liquid metal thus flows through the vacuum space in which the electron source of the X-ray source is accommodated. Therefore, this type of tube is limited to liquid metals which have such a low vapor pressure that, even at the highest operating temperatures occurring, the vacuum in the X-ray source is not affected. Therefore, use must be made of gallium which has a comparatively low atomic number (30) and hence a comparatively low X-ray yield.

However, it is essential to prevent gallium particles from the circulating gallium flow from penetrating the vacuum space of the X-ray source, because the high-voltage strength of the X-ray source could suffer therefrom. This means that the flow of the gallium across the stainless steel plate should be purely laminar, because a turbulent flow could cause the escape of lubricant particles. The flow of the gallium from the distribution head to the stainless steel plate and notably the heating of the gallium by the electron beam favor the occurrence of turbulent flows. Therefore, the gallium may flow only in a thin layer of a thickness of substantially less than 1 mm and also at a speed which is significantly lower than indicated in the cited publication, so that the expected load carrying ability of the X-ray source is significantly reduced.

SUMMARY OF THE INVENTION

It is an object of the present invention to provide an X-ray source having an enhanced continuous load carrying ability. On the basis of an X-ray source of the kind set forth this object is achieved in that a window which can be traversed by the electrons and is cooled by the target is arranged between the electron source and the target.

It is an essential aspect of the invention that the electrons emitted by the electron source are not incident directly on the liquid lubricant, but pass through a window which separates the vacuum space of the X-ray source and the liquid lubricant from one another. It is to be noted that the window absorbs a part of the electrons. However, by choosing a suitable material and a suitably small thickness, the window can be conceived such that it absorbs only a small part of the electron energy (approximately 800 eV). Therefore, the electrons can penetrate the liquid metal and excite X-rays therein without being decelerated by the window to any significant extent. The liquid metal thus has three functions:

a) it converts high energy electrons into X-rays,
b) it effectively removes the heat from the region in which the electrons interact with the liquid metal, and
c) it cools the window.

The use of this window enables the coolant to be guided along the window as a turbulent flow. In the case of a turbulent flow, the mixing of the liquid metal is significantly better in comparison with a laminar flow, so that better cooling is achieved. Moreover, the liquid metal can be guided through the area of interaction with the electrons in a thicker layer and at a higher speed in comparison with a laminar flow. A significantly more effective cooling or a higher continuous load carrying ability is thus achieved.

Moreover, the separation of the vacuum space from the liquid metal allows for the choice of a metal having a vapor pressure higher than that of gallium, but also a higher atomic number so that it converts a larger part of the electron energy into X-rays.

It is to be noted that JP-A 08 036 978 already discloses an X-ray source in which the electrons emitted by an electron source are incident on a target through a window which seals the vacuum space of the X-ray source. The target, evidently being a solid state target, is arranged in a rotatable mount at some distance from the window. In the case of a defect it can be readily replaced by another target in said mount. Because a part of the energy of the electrons is converted into heat in the window, the load carrying ability of the X-ray source is only low, an additional problem being that the outer side of the window is subject to atmospheric conditions so that it must consist of a material which does not react with oxygen when heated.

The window of this invention must be constructed in such a manner that on the one hand it is as stable as possible so as to withstand the flow pressure of the circulating liquid metal, and on the other hand it should draw as little as possible energy from the electrons. A suitable material for the window is diamond, which preferably is arranged on a substrate that faces the electron source, the substrate having an opening at the area of incidence of the electrons.

Besides diamond, other window materials may also be used, for example beryllium or synthetic materials. Mercury, a mercury alloy, or an alloy containing lead and bismuth are suitable targets. Therefore, the term metal must be broadly interpreted in the context of the present invention. It should include not only metals defined by chemical elements, but also their alloys.

An embodiment which includes a pump for causing the liquid metal to circulate in a closed circuit with a predominately turbulent flow at the area of the window provides effective cooling which allows for an increased continuous power. A further embodiment wherein the cross-section of the circuit which is traversed by the liquid metal is substantially smaller at the area of the window than in an area situated farther from the window realizes a turbulent flow at the area of the window. Such a further embodiment can be realized in the simplest manner with a circuit including a duct whose circumference is provided with the window and with a constriction at the area of the window.

An embodiment wherein the electron source is accommodated in an evacuated envelope which is sealed by the window ensures that the vacuum space enclosed by the envelope and the space in which the liquid metal flows are hermetically sealed from one another. Therefore, the liquid metal need not have a low vapor pressure as in the known X-ray source. In the further embodiment wherein the envelope is provided with an exit for the x-rays generated in the target, the X-rays produced in the liquid metal first pass through the window for the electrons before emanating as useful radiation from the X-ray exit window. When the electron beam emitted by the electron source has an elongate cross-section ("strip focus principle"), the plane defined by the electron beam and the emergence of the useful radiation beam should extend perpendicularly to the direction in which the liquid metal flows past the window.

BRIEF DESCRIPTION OF THE DRAWING

The invention will be described in detail hereinafter with reference to the drawings. Therein.

DETAILED DESCRIPTION OF THE PREFERRED EMBODIMENT

Figure 1:
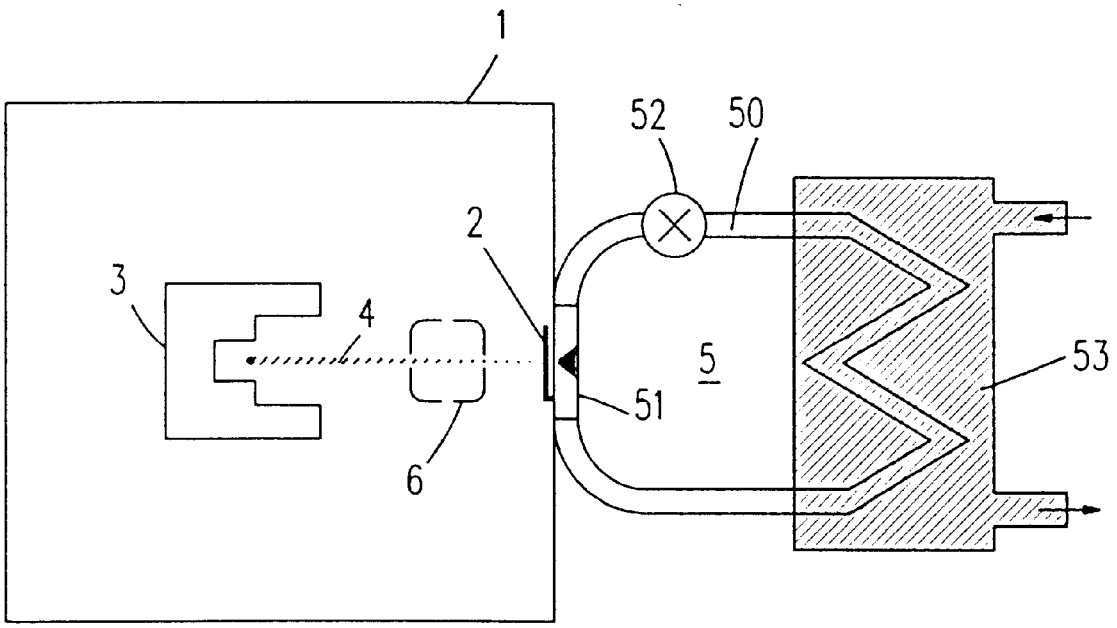
FIG. 1 is a diagrammatic representation of an X-ray source according to the invention.

The reference numeral 1 in FIG. 1 denotes a preferably electrically grounded tube envelope which is sealed in a vacuumtight manner by a window 2. In the vacuum space of the tube envelope there is accommodated an electron source in the form of a cathode 3 which emits an electron beam 4 in the operating condition, which electron beam is incident, through the window 2, on a liquid metal present in a system 5. The system 5 includes a system of ducts 50 in which the liquid metal is driven by a pump 52 and flows past the outer side of the window 2 in a section 51. After having passed the section 51, it enters a heat exchanger 53 wherefrom the heat produced can be drained by means of a suitable cooling circuit.

The interaction between the electrons passing through the window 2 and the liquid metal produces X-rays (i.e. the liquid metal serves as a target) which emanate through the window 2 and an X-ray exit window 6 in the envelope 1. The electron beam 4 preferably has a cross-section which, in conformity with the strip focus principle, has a dimension in the direction perpendicular to the plane of drawing of FIG. 1 which is substantially larger than that in the direction of the plane of drawing. In this case the radiation exit window 6 must be situated (as denoted by dashed lines) in the direction on the circumference of the envelope 1 in which the strip focus is oriented, in a section of the X-ray tube 1 above or below the plane of drawing.

The window 2 serves to seal the tube envelope in a vacuumtight manner and also the section 51 which is traversed by the liquid metal. Moreover, it should be as "transparent" as possible to the electrons 4 (the cathode 3 carries a negative high voltage relative to the tube envelope) so that the electrons produce as little heat as possible during their passage through the window. Moreover, the window should consist of a material having a suitable thermal conductivity. Diamond is a suitable material for the window. Adequate mechanical stability is achieved already in the case of a window thickness of 1 $\mu$m. The loss of energy incurred in such a window by electrons having an energy of 150 keV in such a window is less than 1%, so that the heat flow produced in the window by the electrons is less than 500 W when the liquid metal is heated at 50 kW by the electrons. A further advantage of diamond resides in its high thermal conductivity and in the fact that it can be heated to a temperature as high as 1500° C. without incurring irreversible modifications in an oxygen-free environment.

Figure 2:
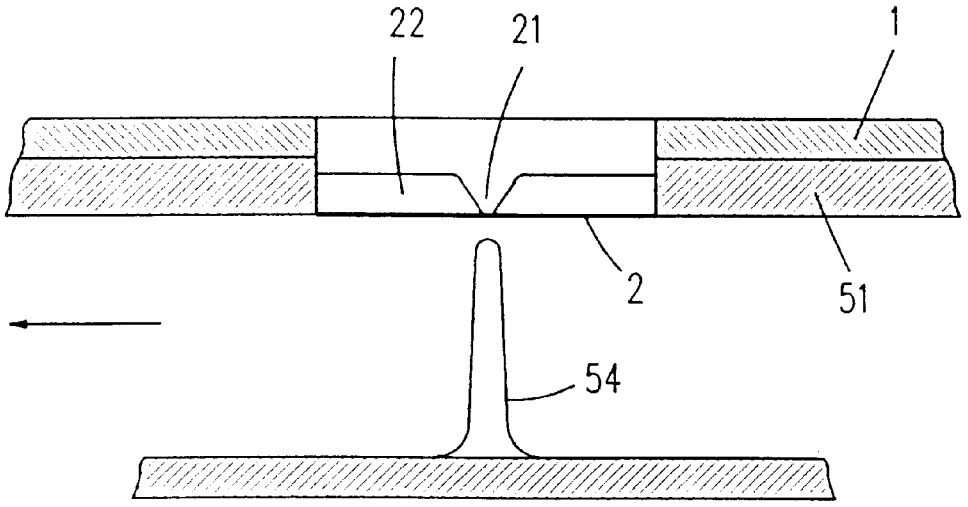
FIG. 2 shows a part of the X-ray source at an increased scale.

FIG. 2 shows the section 51 of the system 5 with the diamond window 2. Such a diamond window can be manufactured, for example as follows. Using a suitable CVD method, a diamond layer having a thickness of 1 $\mu$m is deposited on a silicon substrate 22 having a thickness of 300 $\mu$m and a diameter of 6 mm. Subsequently, using a suitable method, for example etching, an opening 21 of, for example 5 mm×0.8 mm is formed in the silicon substrate at the area where the electron beam is incident, so that only the diamond window remains at this area. The silicon substrate 22 is then suitably connected to the section 51 or the envelope 1. Subsequently, the silicon substrate 22 thus treated is provided with a thin metallization so that it cannot be charged by electrons.

For the liquid metal use can be made of metals or metal alloys which have a high atomic number and are liquid at a low temperature, preferably room temperature.

Mercury, which is fluid already at −39° C., is a suitable metal. A suitable metal alloy consists of 62.5% Ga/21.5% In and 16% Sn (values stated in percentages by weight). This alloy becomes fluid at 10.7° C. Another suitable alloy, partly composed of elements having a higher atomic number, consists of 43% Bi/21.7% Pb/18.3% In/8% Sn/5% Cd and 4% Hg. This alloy becomes liquid at 38° C. Therefore, prior to putting the X-ray source into operation, this alloy must be heated until it is fluid.

For effective dissipation of the heat produced by the electrons it is a prerequisite that the coolant flows past the window sufficiently quickly and in a turbulent flow. It is known that turbulent flows drain thermal energy particularly effectively, because the liquid is particularly quickly mixed by the turbulences occurring. To this end, a liquid flow having a width of 4 mm (corresponding to the window dimensions) and a thickness of approximately 1 mm should be guided past the window. If said thickness were significantly smaller than 1 mm, the heat flow that could be dissipated would be too small; however, if the thickness were significantly larger, there would be a risk of insufficient flow speed at the area of the window.

The system of ducts could then be constructed in such a manner that the liquid metal from the duct 50, having an inner dimension of, for example 6 mm, could be constricted to a cross-section of 4 mm×1 mm via suitable intermediate pieces. However, it is simpler to construct the section 51 so as to have the same inner dimensions as the duct 50 and to provide a constriction 54 in the section 51 only at the area of the window 2 facing the cut-out 21. The flow cross-section is thus constricted to 4 mm×1 mm, so that in this area the flow speed of the liquid metal is substantially higher than in, for example the duct 50. The constriction of the flow cross-section, the heating of the liquid metal by the electrons and the comparatively high speed of the liquid metal (25 $ms^{-1}$) ensure that a turbulent flow occurs at this area. However, at a distance of a few $\mu$m from the window a layer having an approximately laminar flow continues to exist. If necessary, this laminar flow could be eliminated by roughening the window 2 on its side facing the flow.

The pump 52 which drives the liquid metal through the system of ducts 50, 51 can pump the liquid metal through the ducts 50, 51 by means of magnetohydrodynamic forces as disclosed in U.S. Pat. No. 4,953,191. These magnetohydrodynamic forces are produced by the cooperation between the magnetic fields, caused by electric currents in the liquid metal, and external magnetic fields. It is an advantage that a pump of this kind need not comprise mechanically moving parts; however, pumps operating on the basis of other principles may also be used.

The invention allows the X-ray source to operate with a continuous power of that at least 10 kW. Rotating anode X-ray tubes generally have a lower continuous load carrying ability and comprise bearings for the rotating anode which could be damaged by motions, for example in a computer tomography apparatus.

All references cited herein are incorporated herein by reference in their entirety and for all purposes to the same extent as if each individual publication or patent or patent application was specifically and individually indicated to be incorporated by reference in its entirety for all purposes.

What is claimed is:

1. An X-ray source comprising:

an electron source for the emission of electrons, a target which emits X-rays in response to the incidence of the electrons and consists of a liquid metal which circulates in the operating condition of the X-ray source, and a window which can be traversed by the electrons, is cooled by the liquid metal, and is arranged between the electron source and the target.

2. An X-ray source as claimed in claim 1, wherein the window comprises diamond.

3. An X-ray source as claimed in claim 2, wherein the window further comprises a substrate which faces the electron source and is provided with a diamond layer and with an opening at the area of incidence of the electrons.

4. An X-ray source as claimed in claim 1, wherein the target consists of mercury or a mercury alloy.

5. An X-ray source as claimed in claim 1, wherein the target consists of an alloy containing lead and bismuth.

6. An X-ray source as claimed in claim 1, further comprising a closed circuit, and a pump which causes the liquid metal to circulate in the closed circuit so as to have a predominantly turbulent flow at the area of the window.

7. An X-ray source as claimed in claim 6, wherein the cross-section of the closed circuit which is traversed by the liquid metal is substantially smaller at the area of the window than in an area situated further from the window.

8. An X-ray source as claimed in claim 7, wherein the closed circuit further comprises a duct whose circumference is provided with the window and with a constriction at the area of the window.

9. An X-ray source as claimed in claim 1, further comprising an evacuated envelope which is sealed by the window and which accommodates the electron source.

10. An X-ray source as claimed in claim 1, wherein the evacuated envelope further comprises an exit window for the X-rays generated in the target.

* * * * *